US010843898B2

(12) United States Patent
Lee

(10) Patent No.: US 10,843,898 B2
(45) Date of Patent: Nov. 24, 2020

(54) METHOD FOR PREDICTIVE MAINTENANCE AND HIGH EFFICIENCY OPERATION THROUGH ELEVATOR ANALYSIS

(71) Applicant: ITS CO., LTD., Ulsan (KR)

(72) Inventor: Young Kyu Lee, Ulsan (KR)

(73) Assignee: ITS CO., LTD., Ulsan (KR)

( * ) Notice: Subject to any disclaimer, the term of this patent is extended or adjusted under 35 U.S.C. 154(b) by 0 days.

(21) Appl. No.: 16/836,868

(22) Filed: Mar. 31, 2020

(65) Prior Publication Data

US 2020/0223661 A1 Jul. 16, 2020

Related U.S. Application Data

(63) Continuation of application No. PCT/KR2018/013169, filed on Nov. 1, 2018.

(30) Foreign Application Priority Data

Nov. 13, 2017 (KR) ..... 10-2017-0150481

(51) Int. Cl.
*B66B 5/00* (2006.01)
*B66B 5/02* (2006.01)

(52) U.S. Cl.
CPC ..... *B66B 5/0025* (2013.01); *B66B 5/0037* (2013.01); *B66B 5/02* (2013.01)

(58) Field of Classification Search
CPC ..... G05B 2219/24008; G05B 2219/24033; G05B 2219/24048; G05B 2219/24145;
(Continued)

(56) References Cited

U.S. PATENT DOCUMENTS 5,819,202 A * 10/1998 Sato ..... G05B 19/4061 702/33
2002/0173970 A1* 11/2002 Hamada ..... G06Q 10/10 705/305

(Continued)

FOREIGN PATENT DOCUMENTS

JP 2006-502933 A 1/2006
KR 10-1997-0026881 A 6/1997

(Continued)

OTHER PUBLICATIONS

International Search Report issued in PCT/KR2018/013169; dated Feb. 1, 2019.
"Grant of Patent" Office Action issued in KR 10-2017-0150481; mailed by the Korean Intellectual Property Office dated May 17, 2018.

(Continued)

*Primary Examiner* — Marlon T Fletcher
(74) *Attorney, Agent, or Firm* — Studebaker & Brackett PC

(57) ABSTRACT

The present disclosure relates to a method for predictive maintenance and high efficiency operation through elevator analysis, and the method includes: a predictive maintenance step of collecting operation information of an operation unit in a normal state and operation information of the operation unit, which appears before a failure occurs, and detecting an abnormal symptom of the operation unit operating in real time based on the collected operation information so as to induce stable predictive maintenance of the operation unit of the elevator; and a high efficiency operation step of analyzing the operation information of the elevator operation unit in real time based on the operation information of the operation unit in the normal state to extract the operation information of an elevator, and controlling a door-closing time for the elevator based on the extracted operation information so as to induce efficient operation of the elevator.

6 Claims, 15 Drawing Sheets

(58) Field of Classification Search
CPC ..... G05B 2219/32226; G05B 2219/34477; G05B 23/02; G05B 23/0205; G05B 23/0208; G05B 23/021; G05B 2219/31455; G05B 2219/32214; G05B 2219/32371; G05B 2219/32407; G05B 2219/34465; G05B 2219/34475; G05B 2219/50136; G05B 23/0275; B65G 15/00; B65G 2207/40; B65G 43/00; B65G 43/02; A61G 2203/36; A61G 5/04; G01P 7/00; B66B 5/0025; B66B 5/0012; B66B 5/0037; B66B 5/0031; B66B 1/32; B66B 5/0018; B66B 5/02; B66B 25/006; B66B 5/0006; B66B 5/0087; B66B 5/027; B66B 13/24; B66B 1/24; B66B 1/3492; B66B 29/005; B66B 2201/402; B66B 2201/4669; B66B 2201/4684; B66B 5/022; B66B 5/04; B66B 1/3407; B66B 29/00; B66B 5/005; B66B 5/0093; B66B 5/021; B66B 5/024; B66B 5/028; B60T 2201/083
See application file for complete search history.

(56) References Cited

U.S. PATENT DOCUMENTS

| | | | | |
|---|---|---|---|---|
| 2011/0315490 | A1* | 12/2011 | Shi | B66B 5/0025 187/393 |
| 2019/0023529 | A1* | 1/2019 | Lau | B66B 5/14 |
| 2019/0162632 | A1* | 5/2019 | Uchida | G01M 99/005 |
| 2019/0300334 | A1* | 10/2019 | Lee | B66B 5/0031 |
| 2020/0125970 | A1* | 4/2020 | Toyama | G06Q 10/20 |
| 2020/0223661 | A1* | 7/2020 | Lee | B66B 5/02 |

FOREIGN PATENT DOCUMENTS

| | | | |
|---|---|---|---|
| KR | 10-2000-0020216 | A | 4/2000 |
| KR | 10-0365325 | B1 | 12/2002 |
| KR | 10-1387305 | B1 | 4/2014 |

OTHER PUBLICATIONS

"Notification of Reason for Refusal" Office Action issued in KR 10-2017-0150481; mailed by the Korean Intellectual Property Office dated Jan. 19, 2018.

* cited by examiner

FIG. 6

| | Operation frequency at current day | Total operation frequency at current month |
|---|---|---|
| Floor 7 | 45 times | 1350 times |
| Floor 6 | 24 times | 720 times |
| Floor 5 | 21 times | 630 times |
| Floor 4 | 15 times | 450 times |
| Floor 3 | 12 times | 360 times |
| Floor 2 | 6 times | 180 times |
| Floor 1 | 60 times | 2700 times |

FIG. 8

| | Total operation frequency at current month | Electricity rates (Total: 1,742,160) |
|---|---|---|
| Floor 7 | 1350 times | 368,062 Won |
| Floor 6 | 720 times | 196,299 Won |
| Floor 5 | 630 times | 171,762 Won |
| Floor 4 | 450 times | 122,688 Won |
| Floor 3 | 360 times | 98,149 Won |
| Floor 2 | 180 times | 49,076 Won |
| Floor 1 | 2700 times | 736,124 Won |

FIG. 12

| | Operation frequency at current day | Total operation frequency at current month |
|---|---|---|
| Floor 7 | 45 times | 1350 times |
| Floor 6 | 24 times | 720 times |
| Floor 5 | 21 times | 630 times |
| Floor 4 | 15 times | 450 times |
| Floor 3 | 12 times | 360 times |
| Floor 2 | 6 times | 180 times |
| Floor 1 | 60 times | 2700 times |

FIG. 14

| | Total operation frequency at current month | Electricity rates (Total: 1,742,160) |
|---|---|---|
| Floor 7 | 1350 times | 368,062 Won |
| Floor 6 | 720 times | 196,299 Won |
| Floor 5 | 630 times | 171,762 Won |
| Floor 4 | 450 times | 122,688 Won |
| Floor 3 | 360 times | 98,149 Won |
| Floor 2 | 180 times | 49,076 Won |
| Floor 1 | 2700 times | 736,124 Won |

METHOD FOR PREDICTIVE MAINTENANCE AND HIGH EFFICIENCY OPERATION THROUGH ELEVATOR ANALYSIS

CROSS-REFERENCE TO RELATED APPLICATIONS

This application is a Bypass Continuation of International Application No. PCT/KR2018/013169 filed Nov. 1, 2018, which claims benefit of priority to Korean Patent Application No. 10-2017-0150481 filed Nov. 13, 2017, the entire content of which is incorporated herein by reference.

TECHNICAL FIELD

The present invention relates to a method for predictive maintenance and high efficiency operation through elevator analysis and more particularly, to a method for predictive maintenance and high efficiency operation through elevator analysis which not only efficiently prevents a safety accident of the elevator due to a failure of the operation unit of the elevator by collecting operation information (change information of a current value depending on time) of an operation unit in a normal state and operation information of the operation unit which appears before a failure occurs by dividing ascending and descending conditions of an elevator, setting a threshold level based on the collected information and then comparing the operation information of the operation unit, which is collected in real time, with the set threshold level to detect an abnormal symptom of the operation unit in real time and then perform stable predictive maintenance of the operation unit of the elevator, but also induces economically efficient operation of the elevator by analyzing the operation information of the operation unit in real time to extract the operation information of the elevator, digitizing (statisticalizing) a floor-specific operation frequency of the elevator, a time zone, and the number of passengers based on the extracted operation information, and controlling a floor-specific door-closing time for the elevator based on the digitized information.

BACKGROUND ART

In general, elevators are installed for rapid movement between floors of multi-layered buildings, and the installation of the elevators is continuously increasing due to an increase of high-rise buildings and convenience of use. In Korea, about 25,000 elevators are newly installed every year, and about 2 million elevators are expected to be installed by 2020.

Such an elevator is largely configured to include an elevator car moving by accommodating passengers, an operation unit of operating the elevator car through a rope, a control unit for controlling the operation of the elevator, and a power supply unit for supplying power.

In this case, the operation unit is a mechanical device for substantially operating the elevator. Due to the characteristics of the elevator reciprocating vertically between lower floors and higher floors, the periodic inspection and management of the operation unit are required to easily protect the safety of the passengers.

Therefore, conventional elevators are inspected regularly by experts to prevent safety accidents of elevators. However, there is a problem that it is difficult to effectively prevent safety accidents of the elevators because it is difficult to predictively maintain a failure of the operation unit of the elevator due to a current state in which an inspection interval of the elevator is generally equal to or less than 2 years.

Therefore, there is an urgent need for the development of a method that can predictively maintain the failure of the operation unit of the elevator.

On the other hand, due to characteristics in which the elevator is generally operated manually by a passenger, conditions such as a floor-specific operation frequency, a time zone, the number of passengers, and the like are not considered at all, and thus, the efficient operation of the elevator is not performed.

In addition, in electricity rates for the operation of the elevator, there is a problem in that a situation for floor-specific substantial electricity use such as a floor-specific operation frequency and the like is not considered at all and an electricity rate is generally settled for each floor, and thus, the rate settlement of the elevator is not reasonably performed in the related art.

DISCLOSURE

Technical Problem

The present invention is proposed to solve the problems above and directed to providing a method for predictive maintenance and high efficiency operation through elevator analysis which not only efficiently prevents a safety accident of the elevator due to a failure of the operation unit of the elevator by collecting operation information (change information of a current value depending on time) of an operation unit in a normal state and operation information of the operation unit which appears before a failure occurs by dividing ascending and descending conditions of an elevator, setting a threshold level based on the collected information and then comparing the operation information of the operation unit, which is collected in real time, with the set threshold level to detect an abnormal symptom of the operation unit in real time and then perform stable predictive maintenance of the operation unit of the elevator, but also induces economically efficient operation of the elevator by analyzing the operation information of the operation unit in real time to extract the operation information of the elevator, digitizing (statisticalizing) a floor-specific operation frequency of the elevator, a time zone, and the number of passengers based on the extracted operation information, and controlling a floor-specific door-closing time for the elevator based on the digitized information.

Further, the present invention is directed to providing a method for predictive maintenance and high efficiency operation through elevator analysis in which an operation unit divides current values (operation information) varying depending on time of the operation unit, which are collected due to characteristics applied to an elevator, into an unlocking period, a starting period, a constant speed period, a stopping period, and a lock performing period to collect the divided current values, and compares operation information of the operation unit, which is collected in real time, with an upper limit value and a lower limit value of a threshold level corresponding to each period to detect an abnormal symptom of the operation unit, so as to easily detect a part (device) suspected of having an abnormal symptom, thereby not only performing precise predictive maintenance of the operation unit of the elevator, but also ensuring excellent reliability with respect to a detection result of the operation unit of the elevator.

Further, the present invention is directed to providing a method for predictive maintenance and high efficiency operation through elevator analysis which may clearly distribute electricity rates for elevator operation in proportion to a digitized floor-specific operation frequency of an elevator to induce a very reasonable rate settlement.

Technical Solution

An aspect of the present invention provides a method for predictive maintenance and high efficiency operation through elevator analysis, the method comprising: a predictive maintenance step (S10) of collecting, by an operation unit of an elevator, operation information of the operation unit in a normal state and operation information of the operation unit, which appears before a failure occurs, and detecting an abnormal symptom of the operation unit operating in real time on the basis of the collected operation information so as to induce stable predictive maintenance of the operation unit of the elevator; and a high efficiency operation step (S20) of analyzing the operation information of the elevator operation unit in real time on the basis of the operation information of the operation unit in the normal state, which is collected in the predictive maintenance step (S10), to extract the operation information of an elevator, and controlling a door-closing time for the elevator on the basis of the extracted operation information so as to induce efficient operation of the elevator.

Further, the predictive maintenance step (S10) may comprise a first base information collection step (S11) in which the elevator operation unit measures magnitude change information of a current value depending on time of the operation unit at the time of ascending of the elevator in the normal state, the operation unit measures magnitude change information of a current value depending on time of the operation unit at the time of descending of the elevator in the normal state, and the measured operation information is divided into the operation information of the operation unit at the time of ascending of the elevator and the operation information of the operation unit at the time of descending of the elevator to be stored as base information of the operation unit, respectively, a second base information collection step (S12) of measuring the magnitude change information of the current value depending on time measured in the operation state of the operation unit before the failure of the operation unit occurs at the same time of ascending of the elevator, measuring the magnitude change information of the current value depending on time measured in the operation state of the operation unit before the failure of the operation unit occurs at the same time of descending of the elevator, and dividing the measured information into information of the operation unit at the same time of ascending of the elevator and information of the operation unit at the same time of descending of the elevator to store the divided information as base information of the operation unit, respectively, a setting step (S13) of setting threshold levels of the current values depending on time of the operation unit at the time of ascending of the elevator and the operation unit at the time of descending of the elevator based on the information collected in the base information collection steps (S11 and S12), respectively, and a detection step (S14) including a first step (S141) of measuring and collecting magnitude change information of the current value depending on time which is measured in the operation state of the operation unit in real time when the operation unit is operated, a second step (S142) of determining ascending or descending of the elevator by comparing the measurement information collected in the first step (S141) with the base information collected in the first base information collection step (S11), and a third step (S143) of detecting the abnormal symptom of the operation unit by comparing the measurement information collected in the first step (S141) with the threshold level of the setting step (S13) corresponding to the determination information determined in the second step (S142).

Further, the magnitude change information of the current value depending on time of the operation unit collected in the base information collection steps (S11 and S12) may be divided into an unlocking period of unlocking the brake of the elevator for ascending or descending of the elevator, a starting period of starting the operation of the operation unit for ascending or descending of the elevator, a constant speed period of stabilizing and maintaining the current value of the operation unit in a predetermined range in the process of ascending or descending of the elevator, a stopping step of stopping the operation of the operation unit for stopping of the elevator, and a lock performing period of performing the brake locking of the elevator, in the setting step (S13), an upper limit value and a lower limit value of a threshold level are set with respect to each of the unlocking period, the starting period, the constant speed period, the stopping period, and the lock performing period, and in the third step (S143) of the detection step (S14), the abnormal symptom is detected by comparing the current value depending on time of the operation unit operated in real time with the upper limit value and the lower limit value of the threshold level for each period, wherein when the current value of the operation unit in real time is formed more than the upper limit value or less than the lower limit value of the threshold level in one period, the state of the operation unit is detected as an attention state, when the current value of the operation unit in real time is formed more than the upper limit value or less than the lower limit value of the threshold level in two periods, the state of the operation unit is detected as an alarm state, and when the current value of the operation unit in real time is formed more than the upper limit value or less than the lower limit value of the threshold level in three or more periods, the state of the operation unit is detected as a dangerous state.

Further, the high efficiency operation step (S20) may comprise an operation information storage step (S21) of measuring the operation information of the operation unit in real time when the operation unit of the elevator is operated and extracting and storing operation information of the elevator by analyzing the measurement information based on the base information of the operation unit collected in the first base information collection step (S11), and an operation control step (S22) of analyzing and digitizing the elevator operation information stored for a long time in the operation information storage step (S21), and controlling a floor-specific door-closing time of the elevator based on the digitized information.

Further, the operation information storage step (S21) may be a step of dividing and collecting the operation information of the operation unit collected in real time into a starting period, a constant speed period, and a stopping period included in the first base information collection step (S11) and tracking the operation period of the elevator by comparing the base information collected in the first base information collection step (S11) based on the time when the collected constant speed period is maintained and the current value information to finally extract and store a floor-specific operation frequency of the elevator, and the operation control step (S22) may be a step of digitizing a floor-specific operation frequency of the elevator based on the information collected for a long time in the operation information storage step (S21) and extending a door-closing time of the elevator on the floors in which the operation is frequent based on the digitized information to induce passengers to get in the elevator as many as possible and naturally decrease an operation frequency of the elevator.

Further, in the operation information storage step (S21), information about a time zone when the elevator operation unit is operated and the number of passengers is extracted and stored, and the operation control step (S22) may be to control a door-closing time of the elevator based on the digitized information about the time zone when the operation unit is operated and the passengers together with the floor-specific operation frequency of the elevator.

Further, the method may further comprise a settlement step (S23) of separating and settling floor-specific elevator electricity rates in proportion to the floor-specific operation frequency based on the floor-specific operation frequency of the elevator digitized in the operation control step (S22).

Advantageous Effects

As described above, according to the method for predictive maintenance and high efficiency operation through elevator analysis, it is possible to not only efficiently prevent a safety accident of the elevator due to a failure of the operation unit of the elevator by collecting operation information (change information of a current value depending on time) of an operation unit in a normal state and operation information of the operation unit which appears before a failure occurs by dividing ascending and descending conditions of an elevator, respectively, setting a threshold level based on the collected information and then comparing the operation information of the operation unit, which is collected in real time, with the set threshold level to detect an abnormal symptom of the operation unit in real time and then perform stable predictive maintenance of the operation unit of the elevator, but also induce economically efficient operation of the elevator by analyzing the operation information of the operation unit in real time to extract the operation information of the elevator, digitizing (statisticalizing) a floor-specific operation frequency of the elevator, a time zone, and the number of passengers based on the extracted operation information, and controlling a floor-specific door-closing time for the elevator based on the digitized information.

Further, according to the present invention, the operation unit divides current values (operation information) varying depending on time of the operation unit, which are collected due to characteristics applied to an elevator, into an unlocking period, a starting period, a constant speed period, a stopping period, and a lock performing period to collect the divided current values, and compares operation information of the operation unit, which is collected in real time, with an upper limit value and a lower limit value of a threshold level corresponding to each period to detect an abnormal symptom of the operation unit, so as to easily detect a part (device) suspected of having an abnormal symptom, thereby not only performing precise predictive maintenance of the operation unit of the elevator, but also ensuring excellent reliability with respect to a detection result of the operation unit of the elevator.

Further, according to the present invention, it is possible to clearly distribute electricity rates for elevator operation in proportion to a digitized floor-specific operation frequency of an elevator to induce a very reasonable rate settlement.

DESCRIPTION OF DRAWINGS

FIG. 6 is threshold level of operation unit at the time of ascending of elevator.

FIG. 8 is step of detecting abnormal symptom in unlocking period and starting period of operation unit.

FIG. 12 is floor-specific operation frequency of elevator.

FIG. 14 is floor-specific electricity rate according to operation frequency of elevator.

Figure 1:
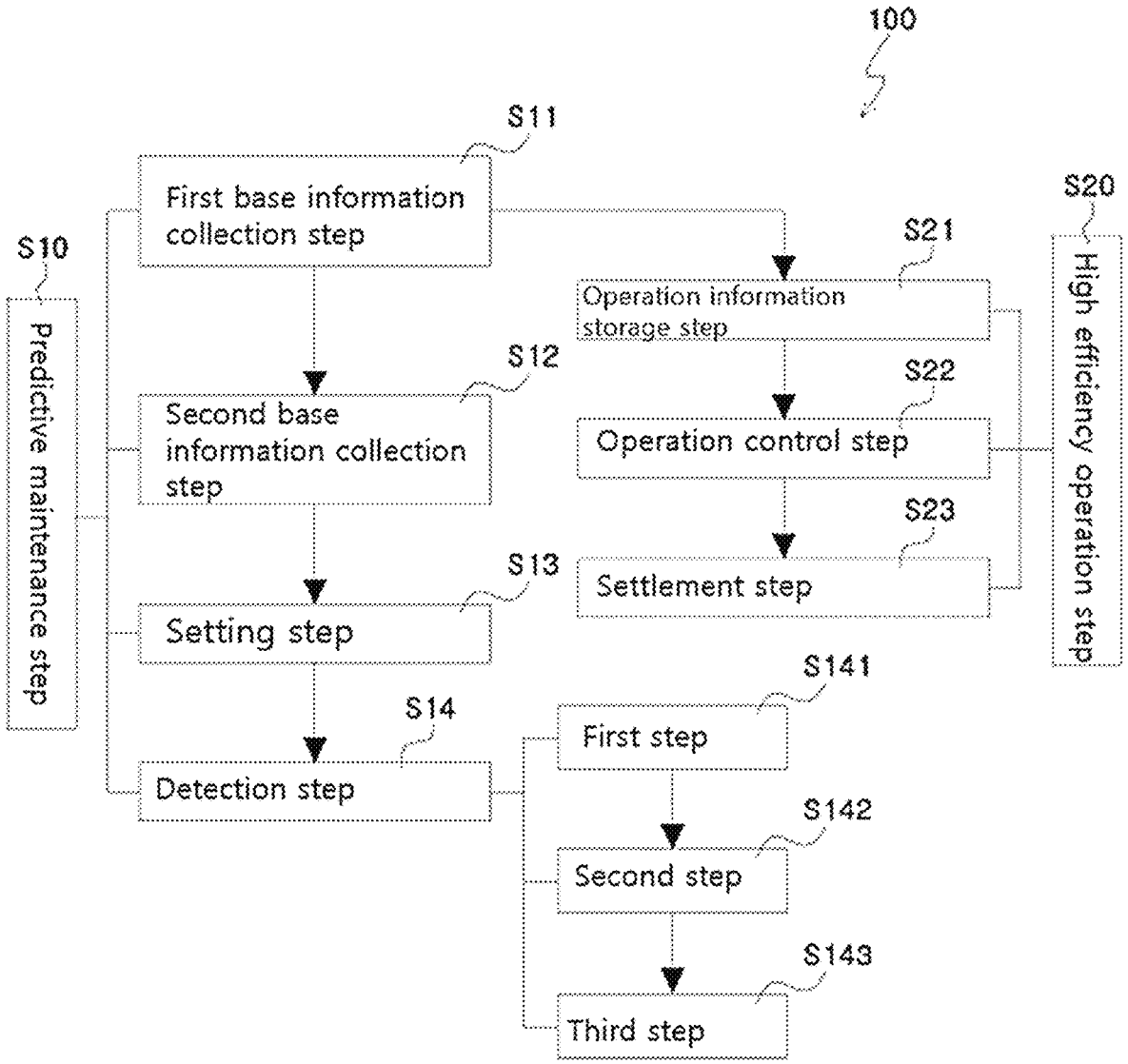
FIG. 1 is a block diagram of a method for predictive maintenance and high efficiency operation through elevator analysis according to an exemplary embodiment of the present invention.

| [Description of Main Reference Numerals of Drawings] | |
|---|---|
| S10: Predictive maintenance step | S11: First base information collection step |
| S12: Second base information collection step | S13: Setting step |
| S14: Detection step | S141: First step |
| S142: Second step | S143: Third step |
| S20: High efficiency operation step | S21: Operation information storage step |
| S22: Operation control step | S23: Settlement step |
| 100: Method for predictive maintenance and high efficiency operation through elevator analysis | |

BEST MODE

A method for predictive maintenance and high efficiency operation through elevator analysis according to a preferred exemplary embodiment of the present invention will be described in detail with reference to the accompanying drawings. The detailed description of publicly-known function and configuration that may make the gist of the present invention unnecessarily ambiguous will be omitted.

FIG. 1 is a block diagram of a method for predictive maintenance and high efficiency operation through elevator analysis according to an exemplary embodiment of the present invention.

As illustrated in FIG. 1, a method 100 for predictive maintenance and high efficiency operation through elevator analysis according to an exemplary embodiment of the present invention includes a predictive maintenance step (S10) and a high efficiency operation step (S20).

The predictive maintenance step (S10) is a step of collecting, by the operation unit of the elevator, operation information of an operation unit in a normal state and operation information of the operation unit which appears before a failure occurs and detecting an abnormal symptom of the operation unit to be operated in real time based on the collected operation information to induce stable predictive maintenance of the operation unit of the elevator.

The predictive maintenance step (S10) includes a first base information collection step (S11), a second base information collection step (S12), a setting step (S13), and a detection step (S14).

The first base information collection step (S11) is a step in which the elevator operation unit measures magnitude change information of a current value depending on time of the operation unit at the time of ascending of the elevator in the normal state, the operation unit measures magnitude change information of a current value depending on time of the operation unit at the time of descending of the elevator in the normal state, and the measured operation information is divided into the operation information of the operation unit at the time of ascending of the elevator and the operation information of the operation unit at the time of descending of the elevator to be stored as base information of the operation unit, respectively.

Here, the elevator is a structure that continuously ascends or descends to or from low and high floors, and due to characteristics of ascending or descending of the elevator by the power of the operation unit, the operation information (magnitude change information of a current value depending on time) of the operation unit collected in the first base information collection step (S11) may be divided into the operation information of the operation unit at the time of ascending of the elevator and the operation information of the operation unit at the time of descending of the elevator to be collected, respectively.

Figure 2:
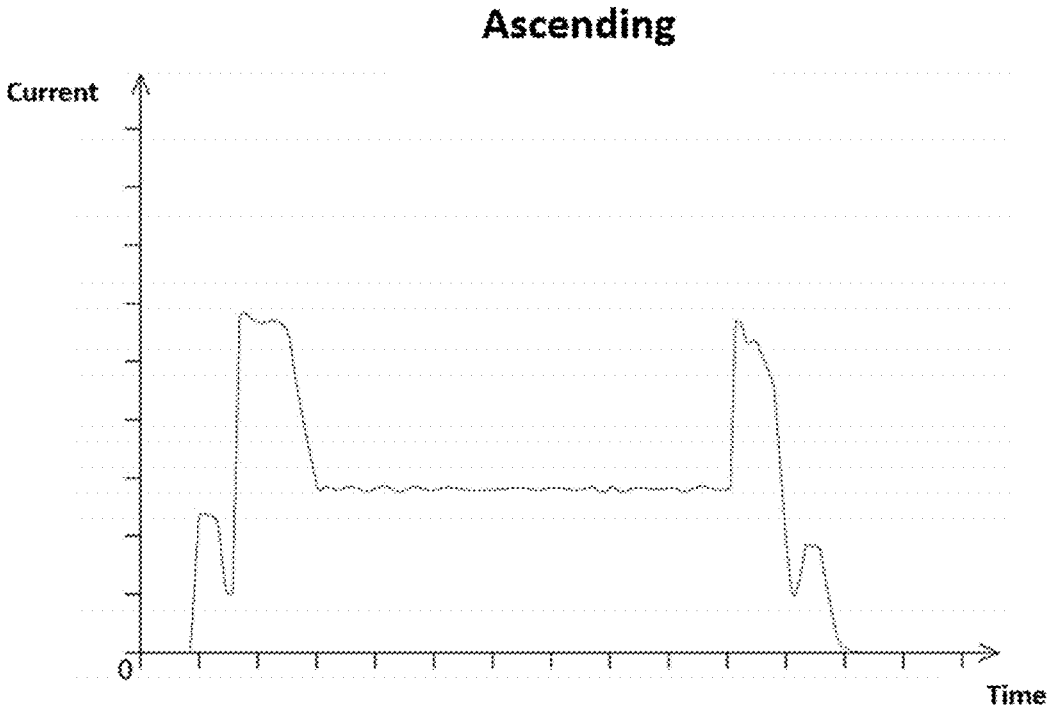
FIG. 2 is current value depending on time of operation unit at the time of ascending of elevator.
Figure 3:
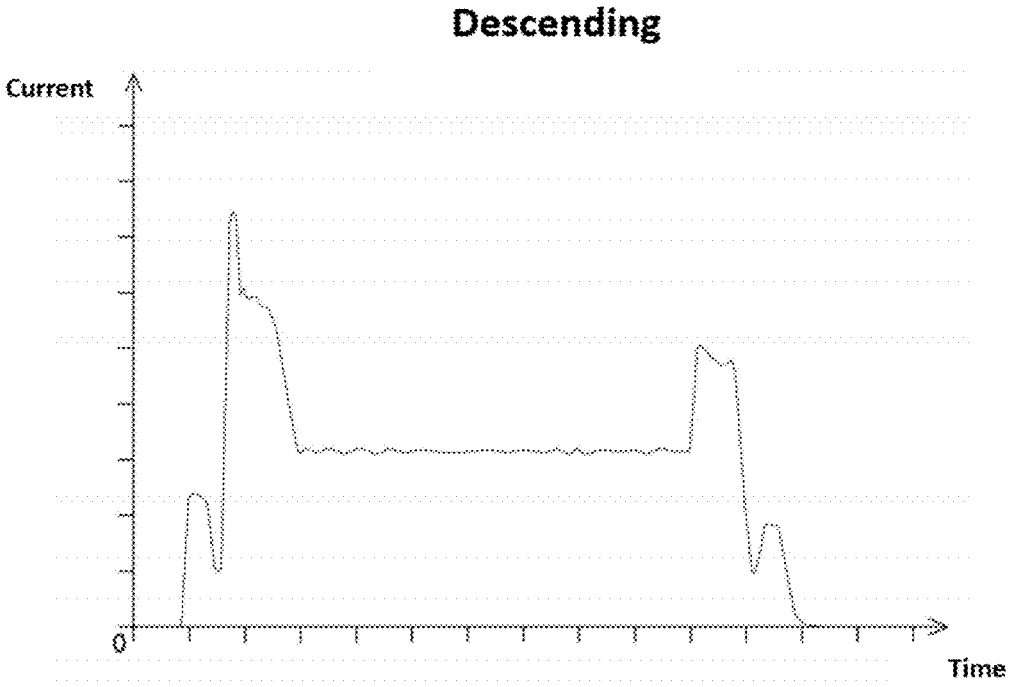
FIG. 3 is current value depending on time of operation unit at the time of descending of elevator.

For describing the reason, as illustrated in FIGS. 2 and 3, in which the operation information of the operation unit at the time of ascending of the elevator and the operation information of the operation unit at the time of descending of the elevator are illustrated as graphs (waveforms), it can be seen that a current value required in the operation unit at the time of descending of the elevator is formed slightly higher than a current value required in the operation unit at the time of ascending of the elevator and shapes of the waveforms are slightly different from each other.

In other words, the operation information of the operation unit at the time of ascending of the elevator is different from the operation information of the operation unit at the time of descending of the elevator, and thus, in order to clearly detect an abnormal symptom of the operation unit in real time in the detection step (S14) to be described below, the operation information of the operation unit needs to be collected and compared by dividing ascending and descending conditions of the elevator.

Accordingly, in the first base information collection step (S11), the operation information of the operation unit in the normal state is collected and the operation information of the operation unit at the time of ascending of the elevator and the operation information of the operation unit at the time of descending of the elevator are divided and collected, respectively.

Meanwhile, when describing steps of starting and stopping the operation of the elevator between a floor and another floor step by step, the steps may be divided into a first step of unlocking a brake of the elevator, a second step of first operating the operation unit for ascending or descending of the elevator, a third step of transferring the elevator to another floor through the operation unit, a fourth step of stopping the operation unit when the transfer of the elevator is completed, and a fifth step of performing locking of the brake of the elevator.

Figure 4:
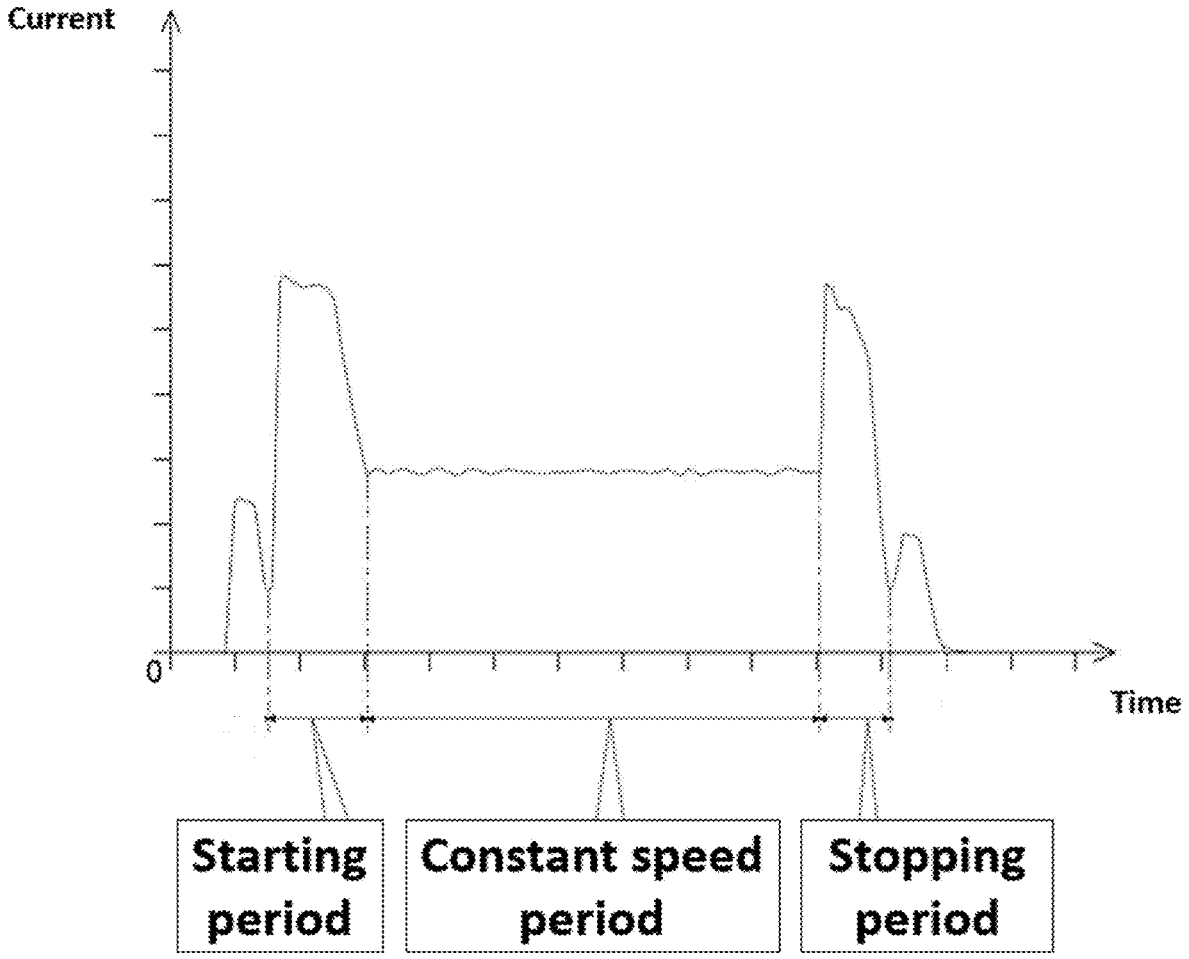
FIG. 4 is current value depending on time of operation unit at the time of ascending of elevator.
Figure 5A:
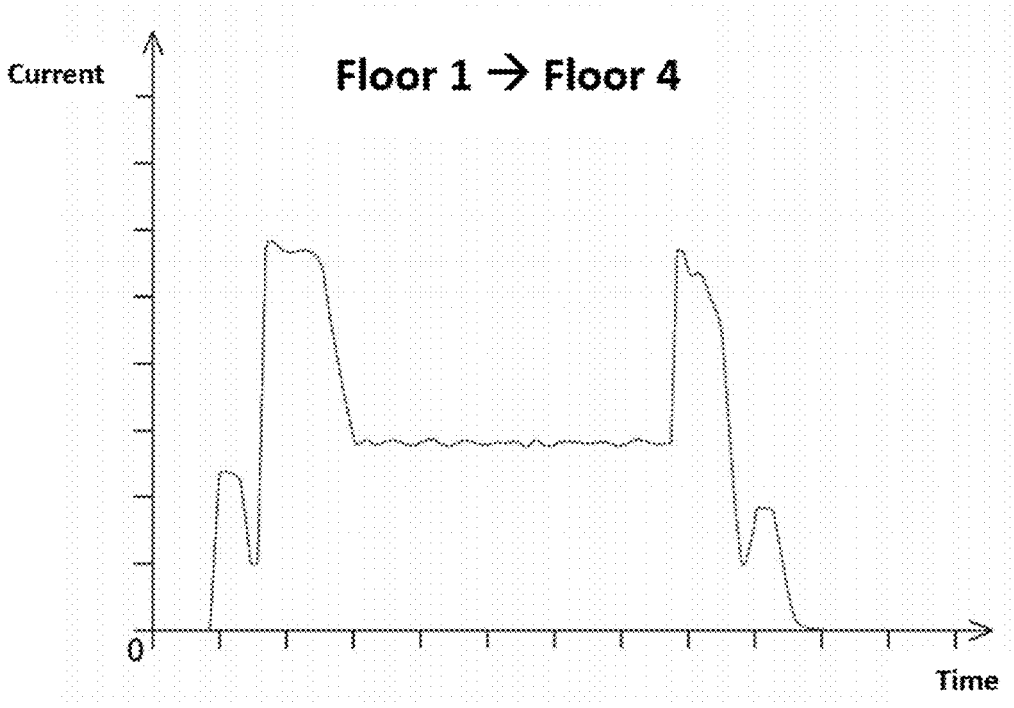
FIGS. 5A and 5B are current value depending on time of operation unit at the time of descending of elevator.
Figure 5B:
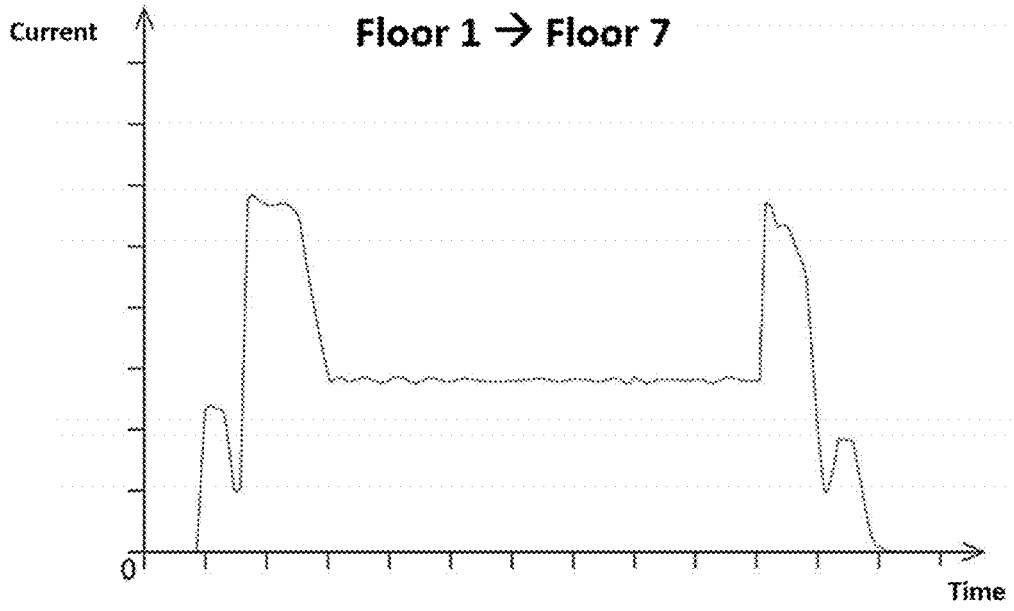

Therefore, in order to clearly detect the abnormal symptom of the operation unit due to the characteristics of detecting the abnormal symptom of the operation unit of the elevator, as illustrated in FIGS. 4 to 5B, the method 100 for predictive maintenance and high efficiency operation through the elevator analysis of the present invention collects the operation information by dividing magnitude change information of the current value depending on time of the operation unit collected in the first base information collection step (S11) into an unlocking period of unlocking the brake of the elevator for ascending or descending of the elevator, a starting period of starting the operation of the operation unit for ascending or descending of the elevator, a constant speed period of stabilizing and maintaining the current value of the operation unit in a predetermined range in the process of ascending or descending of the elevator, a stopping period of stopping the operation of the operation unit for stopping of the elevator, and a lock performing period of performing the brake locking of the elevator.

Meanwhile, of course, the range of the current value recognized as the constant speed period may be set to various ranges in consideration of the conditions, such as a size, and a capacity of the elevator.

The information collected as described above is the basis of threshold level reference values (upper and lower limit values) set to detect the abnormal symptom of the elevator operation unit in the setting step (S13) and the detection step (S14) to be described below.

The second base information collection step (S12) is a step of measuring the magnitude change information of the current value depending on time measured in the operation state of the operation unit before the failure of the operation unit occurs at the same time of ascending of the elevator, measuring the magnitude change information of the current value depending on time measured in the operation state of the operation unit before the failure of the operation unit occurs at the same time of descending of the elevator, and dividing the measured information into information of the operation unit at the same time of ascending of the elevator and information of the operation unit at the same time of descending of the elevator to store the divided information as base information of the operation unit, respectively.

Here, the current value depending on time of the operation unit collected in the second base information collection step (S12) is also divided into an unlocking period, a starting period, a constant speed period, a stopping period, and a lock performing period to collect the operation information like the first base information collection step (S11).

The information collected as described above is also based on threshold level reference values (upper and lower limit values) set to detect the abnormal symptom of the elevator operation unit in the setting step (S13) and the detection step (S14).

The setting step (S13) is a step of setting threshold levels of the current values depending on time of the operation unit at the time of ascending of the elevator and the operation unit at the time of descending of the elevator based on the information collected in the base information collection steps (S11 and S12), respectively.

Figure 7A:
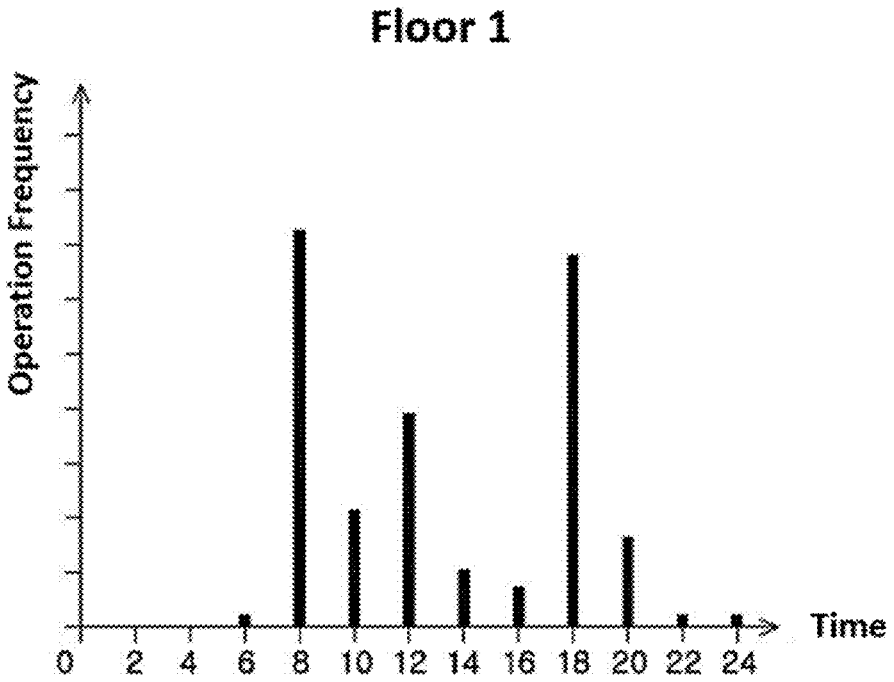
FIGS. 7A to 7D are threshold level of operation unit at the time of descending of elevator.
Figure 7B:
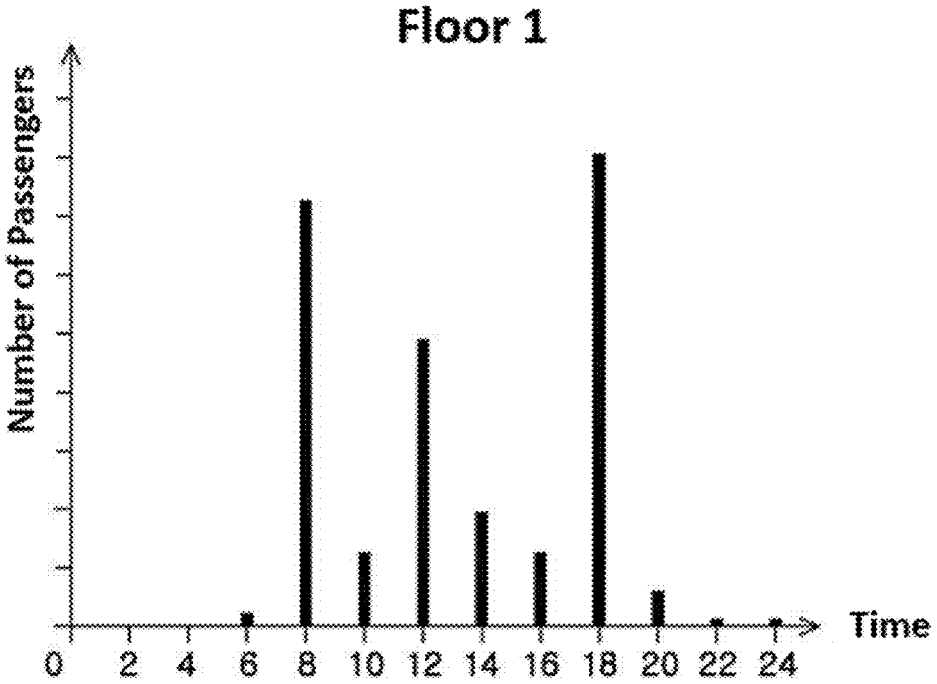
Figure 7C:
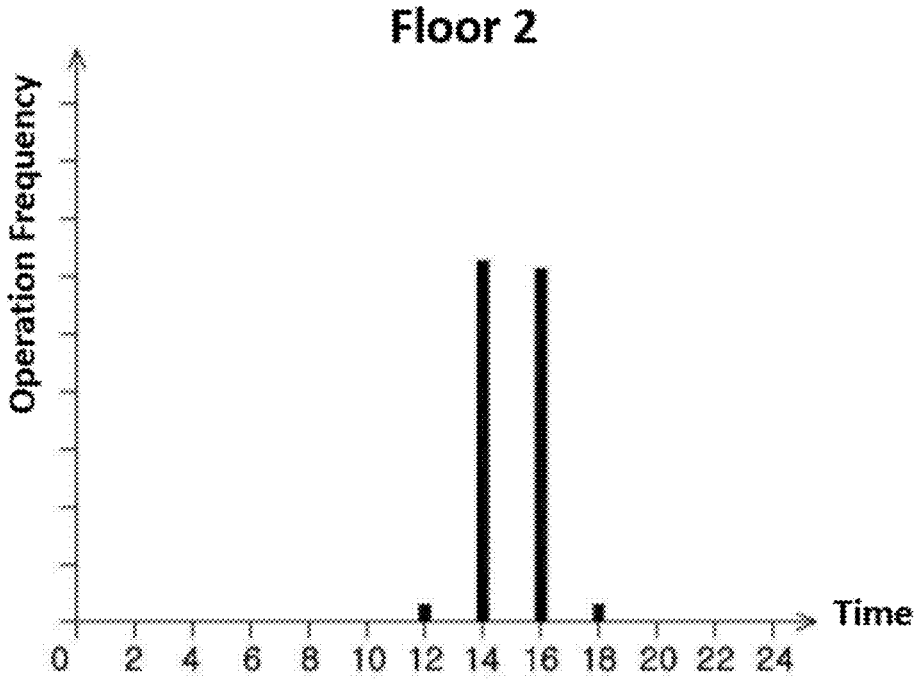
Figure 7D:
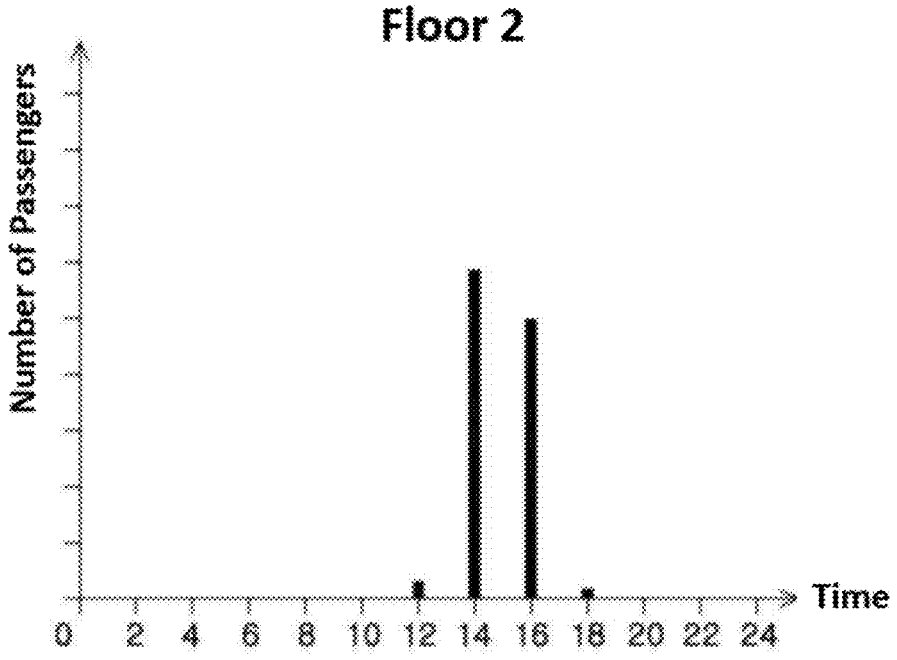

In other words, in the setting step (S13), as illustrated in FIGS. 6 to 7D, upper and lower limit values of the threshold levels are set with respect to the unlocking period, the starting period, the constant speed period, the stopping period, and the lock performing period of the operation units at the time of ascending of the elevator and at the time of descending of the elevator, respectively.

In the detection step (S14), the abnormal symptom of the operation unit operated in real time is detected by a first step (S141), a second step (S142), and a third step (S143).

The first step (S141) is a step of collecting the operation information of the operation unit in real time to examine the abnormal symptom of the operation unit when the operation unit is operated for the operation of the elevator.

The second step (S142) is a step of determining ascending or descending of the elevator by comparing the measurement information collected in the first step (S141) with the base information collected in the first base information collection step (S11).

In other words, as described above, in the case of ascending and descending of the elevator, a difference in current value of the operation unit occurs, so as to determine simply the ascending or descending of the elevator by the current value of the operation unit collected in real time based on the information divided and collected into the ascending and descending of the elevator in the first base information collection step (S11).

The third step (S143) is a step of detecting the abnormal symptom of the operation unit by comparing the measurement information collected in the first step (S141) with the threshold level of the setting step (S13) corresponding to the determination information determined in the second step (S142).

For example, when it is determined that the operation of the operation unit is performed for the ascending of the elevator through the second step (S142), in the third step (S143), the abnormal symptom of the operation unit operated in real time is detected by comparing the threshold level of the operation unit set as a condition of ascending of the elevator in the setting step (S13) with the operation information of the operation unit collected in real time.

Figure 9:
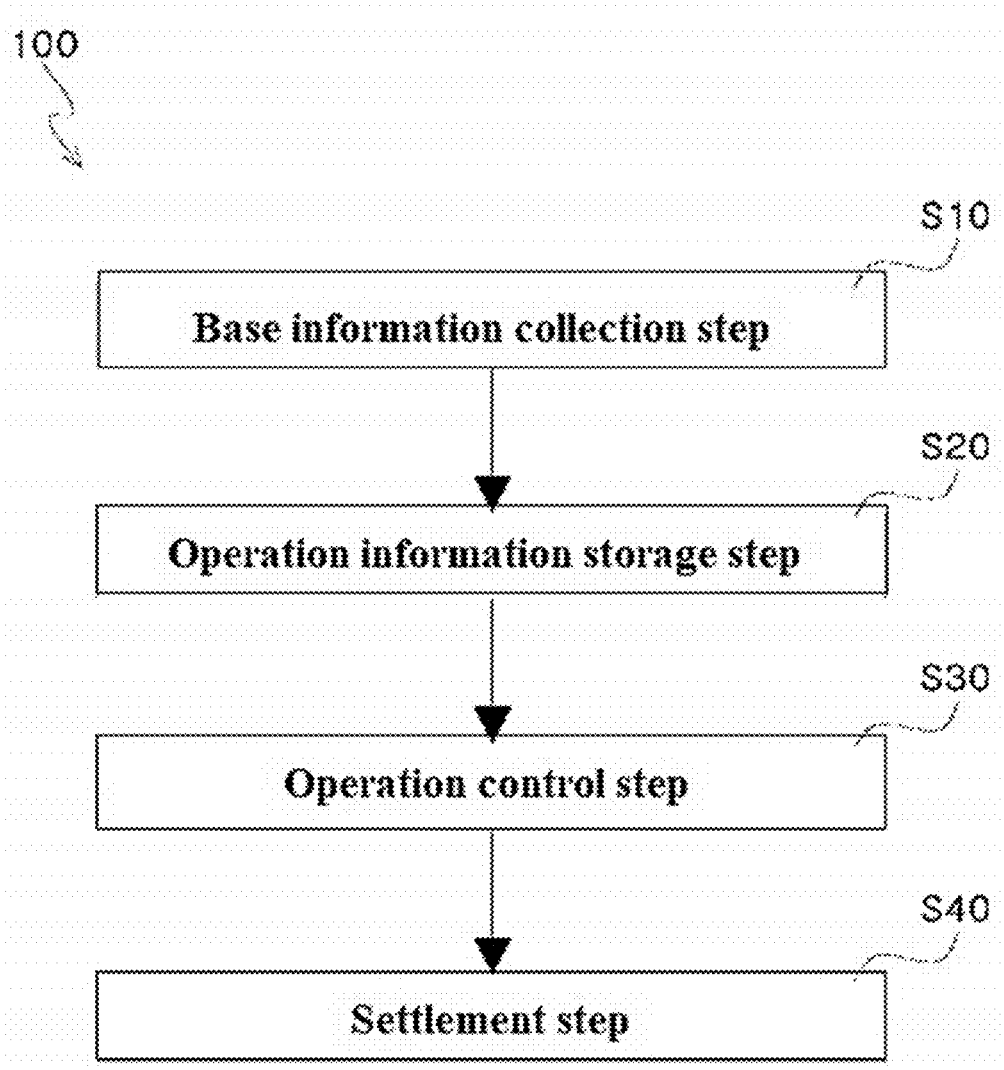
FIG. 9 is step of detecting abnormal symptom in constant speed period, stopping period, and lock performing period of operation unit.

That is, the third step (S143) of the detection step (S14) is to precisely and clearly detect the abnormal symptom of the operation unit operated in real time by comparing the current value depending on time of the operation unit with an upper limit value and a lower limit value of the threshold level set for each period as illustrated in FIGS. 8 and 9.

Figure 10:
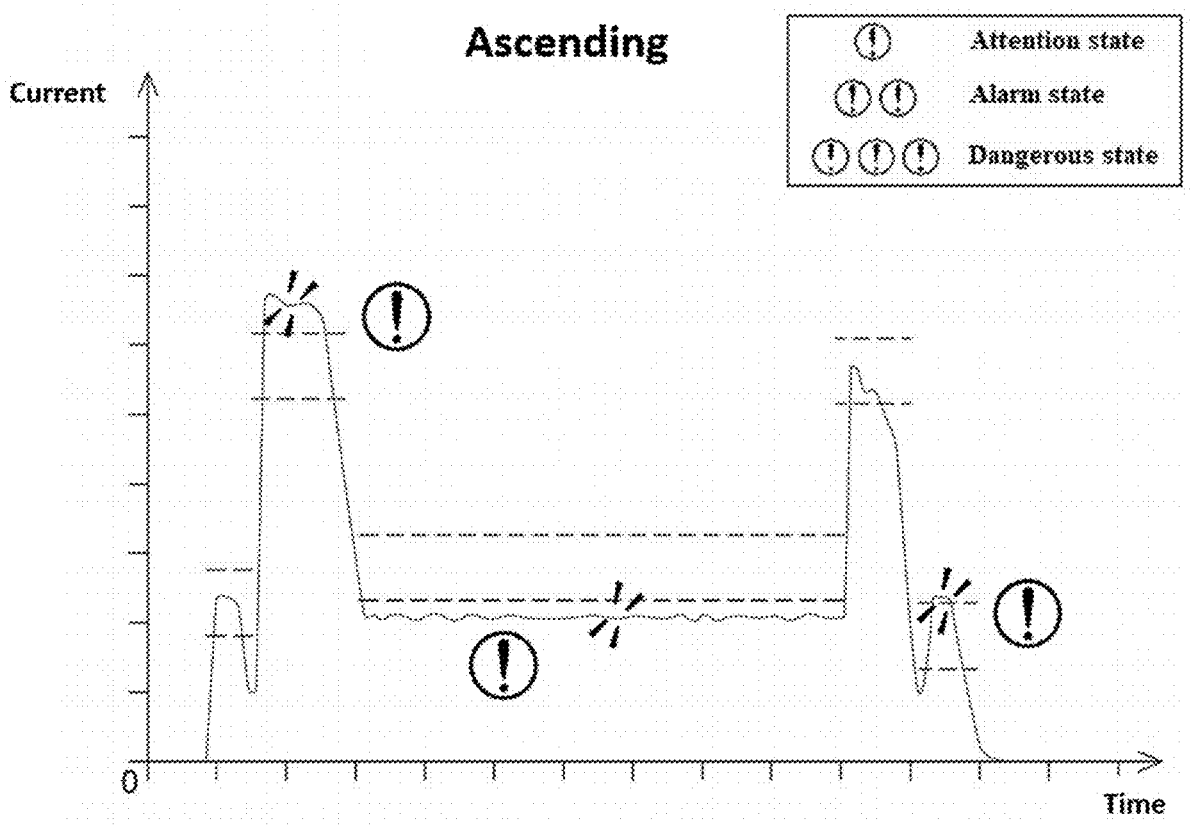
FIG. 10 is detection of abnormal symptom of operation unit.

Therefore, when the abnormal symptom is detected by detecting the abnormal symptom for each period based on the operation information of the operation unit operated in real time as illustrated in FIG. 10, the detected period may be clearly recognized to detect easily a device (a part) suspected of having an abnormal symptom in the operation unit through the detection information, thereby inducing stable management through accurate and precise predictive maintenance of the elevator operation unit.

Meanwhile, when the current value of the operation unit in real time is formed more than the upper limit value or less than the lower limit value of the threshold level in one period, the state of the operation unit is detected as an attention state, and when the current value of the operation unit in real time is formed more than the upper limit value or less than the lower limit value of the threshold level in two periods, the state of the operation unit is detected as an alarm state. In addition, when the current value of the operation unit in real time is formed more than the upper limit value or less than the lower limit value of the threshold level in three or more periods, the state of the operation unit is detected as a dangerous state, and thus, it is possible to induce effective management of the operation unit to be performed by setting a danger level for each step.

Here, of course, the information detected above is sent to an elevator manager through a wired/wireless communication method so as to quickly deal with the time when the abnormal symptom is detected in the elevator.

The high efficiency operation step (S20) is a step of analyzing the operation information of the elevator operation unit in real time based on the operation information of the operation unit in the normal state, which is collected in the predictive maintenance step (S10), to extract the operation information of an elevator, and controlling a door-closing time for the elevator based on the extracted operation information so as to induce efficient operation of the elevator.

The high efficiency operation step (S20) includes an operation information storage step (S21) and an operation control step (S22).

Meanwhile, the operation information of the operation unit collected in the first base information collection step (S11) is divided and collected into a starting period of starting the operation of the operation unit, a constant speed period of stabilizing and maintaining the current value of the operation unit in a predetermined range as a step of ascending or descending of the elevator, and a stopping period of stopping the operation of the operation unit to stop the elevator, as illustrated in FIGS. 4 to 5B.

The starting period and the stopping period are periods in which peak currents (over currents) are instantaneously formed in the operation unit, and a start and an end of the constant speed period may be clearly set (divided) through these periods, and as a result, time information in which the constant speed period is maintained may be clearly extracted with respect to an operation period (operation distance) in which the elevator is operated.

Figure 11A:
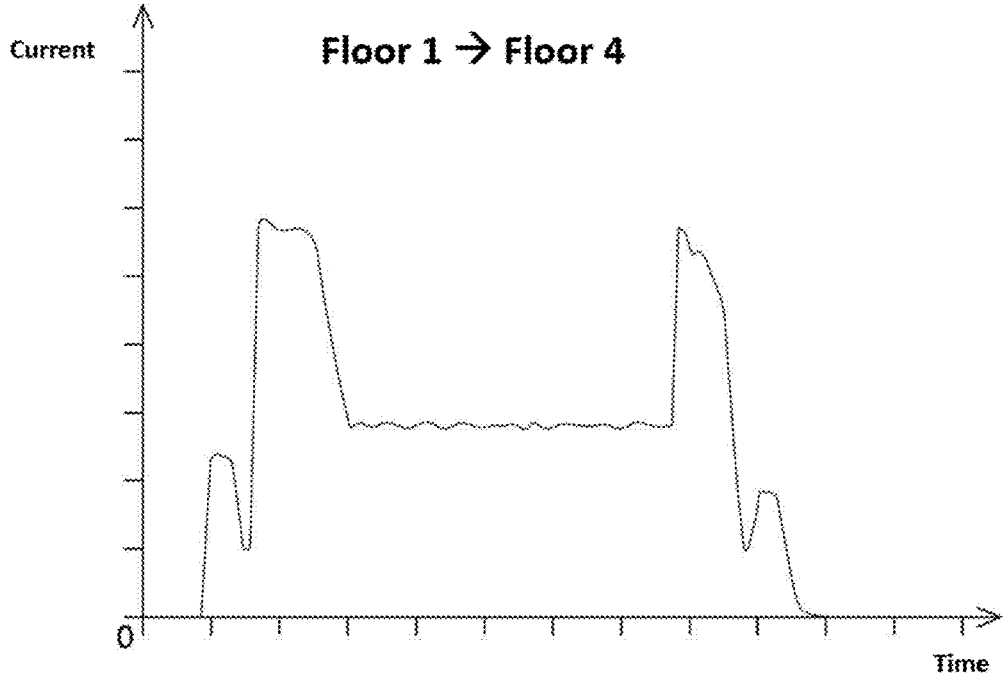
FIGS. 11A and 11B are time when constant speed period is maintained according to operation period of elevator.
Figure 11B:
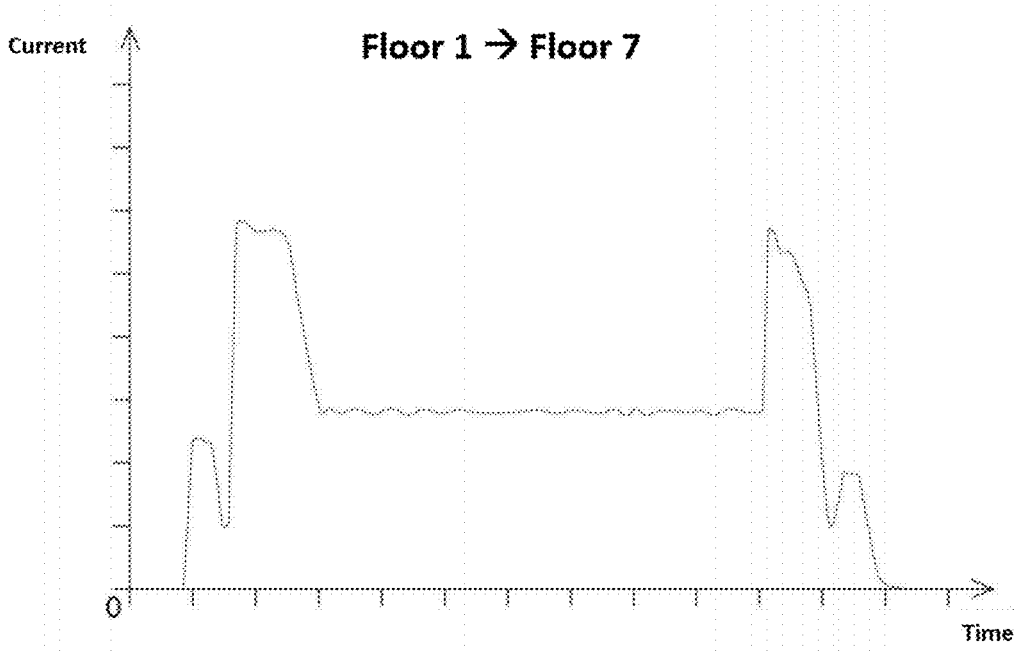
Figure 13A:
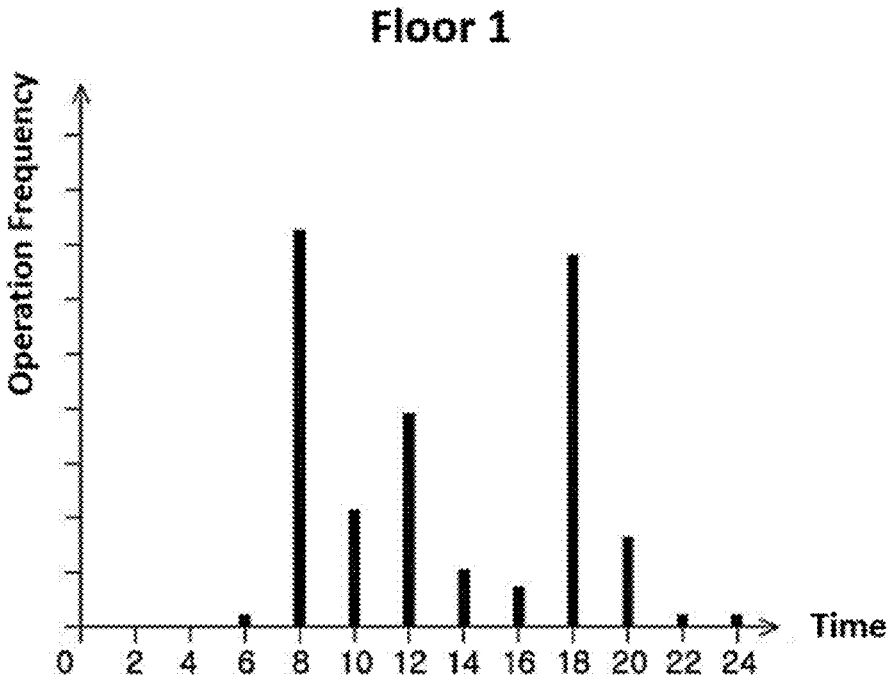
FIGS. 13A to 13D are operation time zone and the number of passenger of elevator.
Figure 13B:
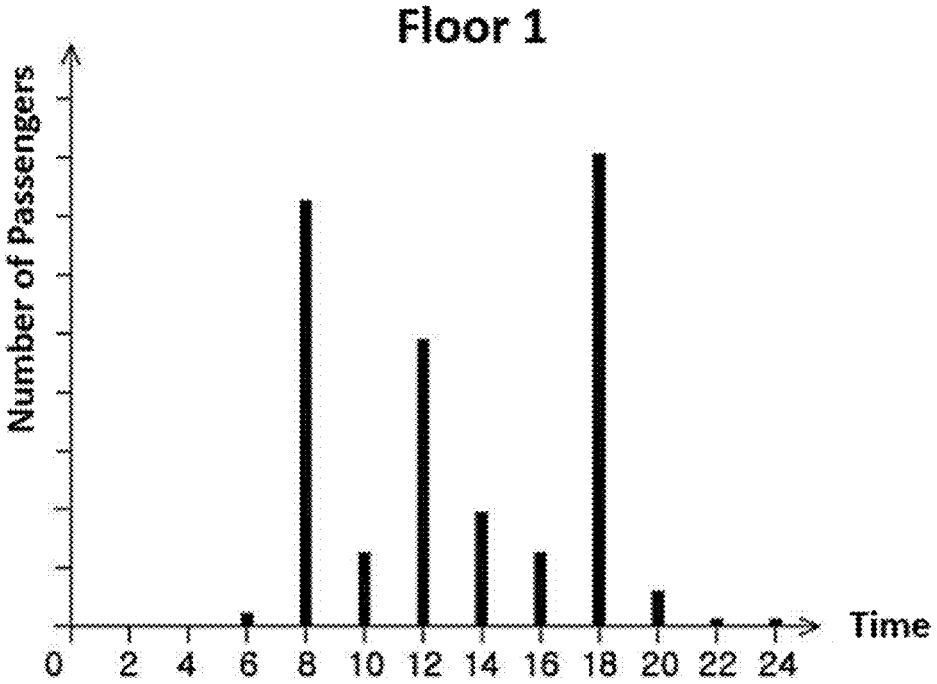
Figure 13C:
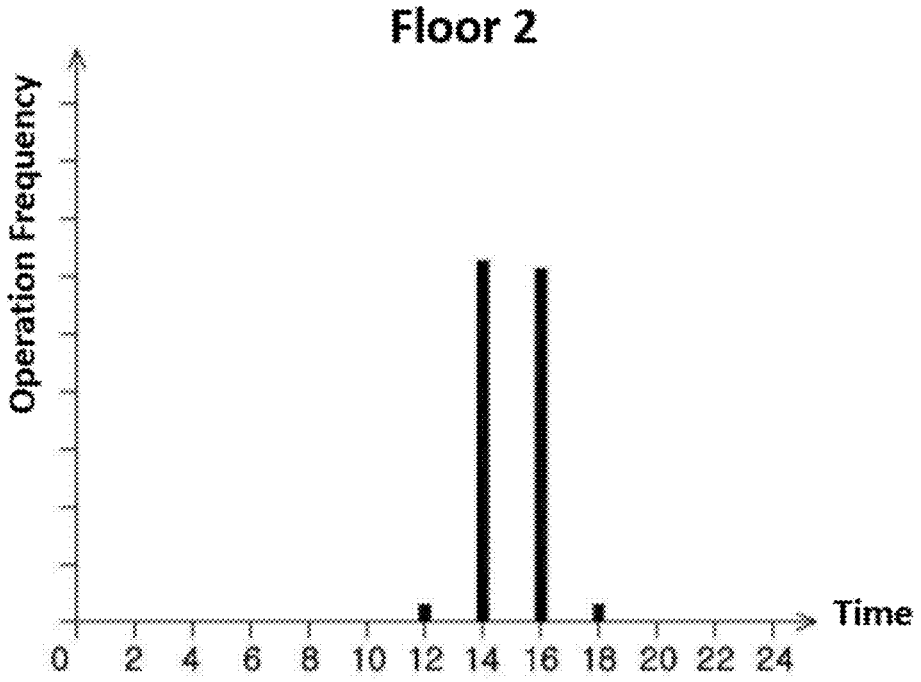
Figure 13D:
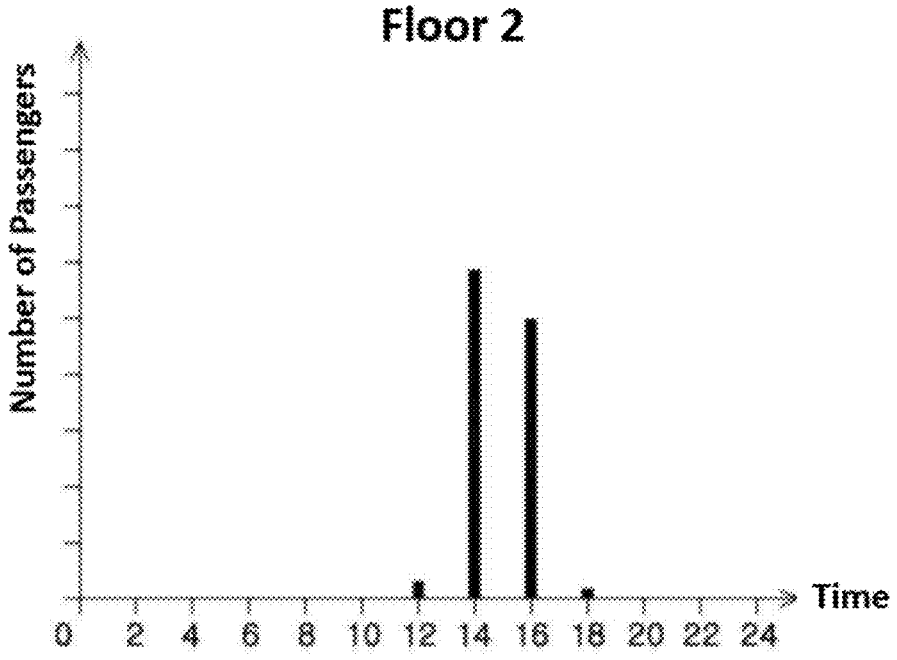

For example, as illustrated in FIGS. 11A and 11B, it can be seen that when the elevator is operated between the floors, a difference in time when the constant speed period of the operation unit is maintained occurs according to the operation period.

Therefore, it is possible to determine the ascending or descending of the elevator through the operation information of the operation unit operated in real time based on the base information collected in the first base information collection step (S11) and to easily extract information about the operation period of the elevator.

In other words, the method 100 for predictive maintenance and high efficiency operation through elevator analysis of the present invention may clearly track the operation period and the position of the elevator simply by tracking and comparing the current value of the operation unit operating the elevator.

The operation information storage step (S21) is a step of measuring the operation information of the operation unit in real time when the operation unit of the elevator is operated and extracting and storing operation information of the elevator by analyzing the measurement information based on the base information of the operation unit collected in the first base information collection step (S11).

Here, the operation information storage step (S21) is a step of dividing and collecting the operation information of the operation unit collected in real time into a starting period, a constant speed period, and a stopping period included in the first base information collection step (S11) and tracking the operation period of the elevator by comparing the base information collected in the first base information collection step (S11) based on the time when the collected constant speed period is maintained and the current value information to finally extract and store a floor-specific operation frequency of the elevator.

In this step, when the operation unit is operated for the operation of the elevator, the operation information is collected in real time and the collected operation information is compared with the operation information of the operation unit collected in the first base information collection step (S11), wherein the operation information collected in the first base information collection step (S11) is primarily compared with the current value of the operation unit collected in real time to determine the ascending and descending of the elevator, and the time when the constant speed period is maintained in the operation information collected in real time is secondarily compared with the operation information collected in the first base information collection step (S11) to track the operation period.

That is, it is possible to easily digitize the operation information of the elevator in the operation control step (S22) to be described below by continuously collecting the real-time operation information of the elevator as described above.

The operation control step (S22) is a step of analyzing and digitizing the elevator operation information stored for a long time in the operation information storage step (S21), and controlling a floor-specific door-closing time of the elevator based on the digitized information.

That is, the operation control step (S22) is a step of digitizing a floor-specific operation frequency of the elevator based on the information collected for a long time in the operation information storage step (S21) and extending a door-closing time of the elevator on the floors in which the operation is frequent based on the digitized information to induce passengers to get in the elevator as many as possible and naturally decrease an operation frequency of the elevator as illustrated in FIG. 12.

In addition, in the operation information storage step (S21), information about a time zone when the elevator operation unit is operated and the number of passengers is extracted and stored.

The operation control step (S22) is to control a door-closing time of the elevator based on the digitized information about the time zone when the operation unit is operated and the passengers together with the floor-specific operation frequency of the elevator as illustrated in FIGS. 13A to 13D.

Here, the number of elevator passengers is approximately calculated by measuring the weight of the passenger using a weight sensor.

In other words, it is possible to more efficiently perform the control of the door-closing time of the elevator by digitizing the information about the floor-specific operation time zone and the number of floor-specific passengers of the elevator together with the floor-specific operation frequency of the elevator. For example, in the case of floors having a high operation frequency at a specific time zone even in floors having a low overall operation frequency, the door-closing time of the elevator is controlled to extend at the specific time zone. On the contrary, in the case of floors having a low operation frequency at a specific time zone even in floors having a high overall operation frequency, the door-closing time of the elevator is controlled to be normally performed at the specific time zone. As a result, the door-closing time of the elevator is efficiently controlled. In addition, of course, the time zone in which the number of passengers is increased also extends the door-closing time of the elevator so that the door closing of the elevator is efficiently controlled.

Meanwhile, the method further includes a settlement step (S23) of separating and settling floor-specific elevator electricity rates in proportion to the floor-specific operation frequency based on the floor-specific operation frequency digitized in the operation control step (S22).

That is, as illustrated in FIG. 14, a monthly rate for the elevator may be clearly separated and set based on the floor-specific overall operation frequency by digitizing the floor-specific operation frequency of the elevator to induce a very reasonable rate settlement.

According to the method 100 for predictive maintenance and high efficiency operation through elevator analysis configured in the above steps, it is possible to not only efficiently prevent a safety accident of the elevator due to a failure of the operation unit of the elevator by collecting operation information (change information of a current value depending on time) of an operation unit in a normal state and operation information of the operation unit which appears before a failure occurs by dividing ascending and descending conditions of an elevator, respectively, setting a threshold level based on the collected information and then comparing the operation information of the operation unit, which is collected in real time, with the set threshold level to detect an abnormal symptom of the operation unit in real time and then perform stable predictive maintenance of the operation unit of the elevator, but also induce economically efficient operation of the elevator by analyzing the operation information of the operation unit in real time to extract the operation information of the elevator, digitizing (statisticalizing) a floor-specific operation frequency of the elevator, a time zone, and the number of passengers based on the extracted operation information, and controlling a floor-specific door-closing time for the elevator based on the digitized information.

Further, the operation unit divides current values (operation information) varying depending on time of the operation unit, which are collected due to characteristics applied to an elevator, into an unlocking period, a starting period, a constant speed period, a stopping period, and a lock performing period to collect the divided current values, and compares operation information of the operation unit, which is collected in real time, with an upper limit value and a lower limit value of a threshold level corresponding to each period to detect an abnormal symptom of the operation unit, so as to easily detect a part (device) suspected of having an abnormal symptom, thereby not only performing precise predictive maintenance of the operation unit of the elevator, but also ensuring excellent reliability with respect to a detection result of the operation unit of the elevator.

Further, it is possible to clearly distribute electricity rates for elevator operation in proportion to a digitized floor-specific operation frequency of an elevator to induce a very reasonable rate settlement.

The present invention has been described with reference to the embodiment illustrated in the accompanying drawings and is just exemplary and is not limited to the above-described embodiments, but it will be appreciated by those skilled in the art that various modifications and exemplary embodiments equivalent thereto can be made therefrom. In addition, modifications by those skilled in the art can be made without departing from the scope of the present invention. Therefore, the scope of the claims in the present invention will not be defined within the scope of the detailed description but will be defined by the following claims and the technical spirit thereof.

The invention claimed is:

1. A method for predictive maintenance and high efficiency operation through elevator analysis, the method comprising:

a predictive maintenance step (S10) of collecting, by an operation unit of an elevator, operation information of the operation unit in a normal state and operation information of the operation unit, which appears before a failure occurs, and detecting an abnormal symptom of the operation unit operating in real time based on the collected operation information so as to induce stable predictive maintenance of the operation unit of the elevator; and a high efficiency operation step (S20) of analyzing the operation information of the elevator operation unit in real time based on the operation information of the operation unit in the normal state, which is collected in the predictive maintenance step (S10), to extract the operation information of an elevator, and controlling a door-closing time for the elevator based on the extracted operation information so as to induce efficient operation of the elevator, wherein, the predictive maintenance step (S10) comprises a first base information collection step (S11) in which the elevator operation unit measures magnitude change information of a current value depending on time of the operation unit at the time of ascending of the elevator in the normal state, the operation unit measures magnitude change information of a current value depending on time of the operation unit at the time of descending of the elevator in the normal state, and the measured operation information is divided into the operation information of the operation unit at the time of ascending of the elevator and the operation information of the operation unit at the time of descending of the elevator to be stored as base information of the operation unit, respectively, a second base information collection step (S12) of measuring the magnitude change information of the current value depending on time measured in the operation state of the operation unit before the failure of the operation unit occurs at the same time of ascending of the elevator, measuring the magnitude change information of the current value depending on time measured in the operation state of the operation unit before the failure of the operation unit occurs at the same time of descending of the elevator, and dividing the measured information into information of the operation unit at the same time of ascending of the elevator and information of the operation unit at the same time of descending of the elevator to store the divided information as base information of the operation unit, respectively, a setting step (S13) of setting threshold levels of the current values depending on time of the operation unit at the time of ascending of the elevator and the operation unit at the time of descending of the elevator based on the information collected in the base information collection steps (S11 and S12), respectively, and a detection step (S14) including a first step (S141) of measuring and collecting magnitude change information of the current value depending on time which is measured in the operation state of the operation unit in real time when the operation unit is operated, a second step (S142) of determining ascending or descending of the elevator by comparing the measurement information collected in the first step (S141) with the base information collected in the first base information collection step (S11), and a third step (S143) of detecting the abnormal symptom of the operation unit by comparing the measurement information collected in the first step (S141) with the threshold level of the setting step (S13) corresponding to the determination information determined in the second step (S142).

2. The method of claim 1, wherein the magnitude change information of the current value depending on time of the operation unit collected in the base information collection steps (S11 and S12) is divided into an unlocking period of unlocking the brake of the elevator for ascending or descending of the elevator, a starting period of starting the operation of the operation unit for ascending or descending of the elevator, a constant speed period of stabilizing and maintaining the current value of the operation unit in a predetermined range in the process of ascending or descending of the elevator, a stopping period of stopping the operation of the operation unit for stopping of the elevator, and a lock performing period of performing the brake locking of the elevator, in the setting step (S13), an upper limit value and a lower limit value of a threshold level are set with respect to each of the unlocking period, the starting period, the constant speed period, the stopping period, and the lock performing period, and in the third step (S143) of the detection step (S14), the abnormal symptom is detected by comparing the current value depending on time of the operation unit operated in real time with the upper limit value and the lower limit value of the threshold level for each period, wherein when the current value of the operation unit in real time is formed more than the upper limit value or less than the lower limit value of the threshold level in one period, the state of the operation unit is detected as an attention state, when the current value of the operation unit in real time is formed more than the upper limit value or less than the lower limit value of the threshold level in two periods, the state of the operation unit is detected as an alarm state, and when the current value of the operation unit in real time is formed more than the upper limit value or less than the lower limit value of the threshold level in three or more periods, the state of the operation unit is detected as a dangerous state.

3. The method of claim 2, wherein the high efficiency operation step (S20) comprises an operation information storage step (S21) of measuring the operation information of the operation unit in real time when the operation unit of the elevator is operated and extracting and storing operation information of the elevator by analyzing the measurement information based on the base information of the operation unit collected in the first base information collection step (S11), and an operation control step (S22) of analyzing and digitizing the elevator operation information stored for a long time in the operation information storage step (S21), and controlling a floor-specific door-closing time of the elevator based on the digitized information.

4. The method of claim 3, wherein the operation information storage step (S21) is a step of dividing and collecting the operation information of the operation unit collected in real time into a starting period, a constant speed period, and a stopping period included in the first base information collection step (S11) and tracking the operation period of the elevator by comparing the base information collected in the first base information collection step (S11) based on the time when the collected constant speed period is maintained and the current value information to finally extract and store a floor-specific operation frequency of the elevator, and the operation control step (S22) is a step of digitizing a floor-specific operation frequency of the elevator based on the information collected for a long time in the operation information storage step (S21) and extending a door-closing time of the elevator on the floors in which the operation is frequent based on the digitized information to induce passengers to get in the elevator as many as possible and naturally decrease an operation frequency of the elevator.

5. The method of claim 4, wherein in the operation information storage step (S21), information about a time zone when the elevator operation unit is operated and the number of passengers is extracted and stored, and the operation control step (S22) is to control a door-closing time of the elevator based on the digitized information about the time zone when the operation unit is operated and the passengers together with the floor-specific operation frequency of the elevator.

6. The method of claim 4, further comprising:

a settlement step (S23) of separating and settling floor-specific elevator electricity rates in proportion to the floor-specific operation frequency based on the floor-specific operation frequency of the elevator digitized in the operation control step (S22).

* * * * *